US007303483B2

(12) United States Patent
Black

(10) Patent No.: US 7,303,483 B2
(45) Date of Patent: Dec. 4, 2007

(54) BILLIARD AIM INSTRUCTION KIT

(76) Inventor: William Edward Black, 2509 Manor Oak Dr., Modesto, CA (US) 95355

( * ) Notice: Subject to any disclaimer, the term of this patent is extended or adjusted under 35 U.S.C. 154(b) by 39 days.

(21) Appl. No.: 11/326,907

(22) Filed: Jan. 7, 2006

(65) Prior Publication Data

US 2006/0166752 A1 Jul. 27, 2006

Related U.S. Application Data

(60) Provisional application No. 60/645,928, filed on Jan. 21, 2005.

(51) Int. Cl.
*A63D 15/00* (2006.01)

(52) U.S. Cl. ..... 473/2

(58) Field of Classification Search ..... 473/2, 473/1, 4, 5, 14

See application file for complete search history.

(56) References Cited

U.S. PATENT DOCUMENTS

| | | | | |
|---|---|---|---|---|
| 3,843,120 | A | 10/1974 | Ricci | |
| 4,120,494 | A * | 10/1978 | Roe | 473/2 |
| 4,151,990 | A | 5/1979 | Josenhans | |
| 4,178,694 | A * | 12/1979 | Bonney | 33/289 |
| 4,183,523 | A * | 1/1980 | Hecht | 473/40 |
| 5,234,379 | A * | 8/1993 | Zotos | 473/2 |
| 5,401,215 | A | 3/1995 | Pfost | |
| 6,045,450 | A | 4/2000 | Cyr | |
| 6,053,817 | A | 4/2000 | Fiegel | |
| 6,761,643 | B2 * | 7/2004 | Boatwright | 473/2 |
| 6,827,651 | B1 | 12/2004 | Davis | |
| 6,975,120 | B2 * | 12/2005 | Amini | 324/339 |
| 7,144,328 | B1 * | 12/2006 | Ellis | 473/2 |
| 2004/0254024 | A1 * | 12/2004 | Thomas | 473/2 |
| 2005/0101395 | A1 * | 5/2005 | Keating | 473/2 |
| 2006/0128488 | A1 * | 6/2006 | Pappas | 473/2 |

FOREIGN PATENT DOCUMENTS

| | | |
|---|---|---|
| GB | 2238481 A | 10/1989 |
| JP | 2003260163 | 9/2003 |

* cited by examiner

*Primary Examiner*—Mitra Aryanpour

(57) ABSTRACT

A billiard aim instruction kit for pocket billiards. A position reference tool is placed at locations on a pocket billiard table surface and aligned aiming toward a pocket. A marking powder packet is used to mark each location. The position reference tool is then removed to reveal each location's aiming point reference mark, 5 object ball position marks, 5 aiming angle reference marks and a center hit cue ball direction reference mark. An object ball is centered on the 5 object ball position marks of each location marked and rail indicators mark the rail for cue ball direction. The student shoots the cue ball from one of 5 different aiming angle reference points a multiplicity of times without further marking procedures. After each shot the student receives feed back as he compares results with the rail indicator and graphics on the position reference tool.

6 Claims, 8 Drawing Sheets

BILLIARD AIM INSTRUCTION KIT

CROSS-REFERENCE TO RELATED APPLICATION

This application claims the benefit of Provisional Patent Application Ser. No. 60/645928 filed 2005 Jan. 21.

FEDERALLY SPONSORED RESEARCH

Not Applicable

SEQUENCE LISTING OR PRINCIPLE

Not Applicable

BACKGROUND-FIELD OF INVENTION

This invention relates to pocket billiards learning aids specifically used to teach pocket billiard players how to properly aim a cue ball at an object ball and pocket the object ball while accurately estimating the range of cue ball direction after impact.

BACKGROUND DESCRIPTION OF PRIOR ART

There are all sorts of teaching aids used to teach people how to aim pocket billiard shots for different angles. U.S. Pat. No. 6,827,651 by Davis shows a device using lasers to locate the position of the cue ball at impact and 1 fixed direction for the cue ball after impact. The device must sit on the table while the shot is practiced and does not indicate a range of cue ball direction after impact. U.S. Pat. No. 6,053,817 by Flegel shows a device made from cloth temporarily positioned on a pocket billiard table surface. A cue ball is then used to roll onto the surface of the device and make contact with other pocket billiard balls set upon the surface of the device. The problem is you must set the balls on the surface of the device to execute each shot and the device does not give feed back about the range of cue ball direction after impact. U.S. Pat. No. 6,045,450 by Cyr shows a targeting disc that is placed in intimate contact with the object ball on the table. Once positioned the student has indication where to aim. The targeting disc is hard to position and must be left on the table while shooting the shot. Another U.S. Pat. No. 5,401,215 uses an object ball coated with an array of colored dots. This device is difficult to understand and does not give information about the cue ball direction after impact. U.S. Pat. No. 4,178,694 by Bonney shows still another device which acts as a point of aim indicator. This device cannot be used with the actual shot and the object ball must be placed on a pedestal to use it properly and there is no indication of cue ball direction after impact. One of the prior art references U.S. Pat. No. 3,843,120 by Ricci shows an apparatus used for marking an aiming point. The apparatus is shaped like a cue ball and designed to be placed in intimate contact with an object ball and then using a stick of chalk or other marking means to mark the aiming point. The apparatus must be used to set up each and every shot practiced restricting the students ability to concentrate on shooting the same shot a multiplicity of times. Ricci's apparatus is very difficult to align and accuracy decreases as you move more than 18" or so away from the target pocket. The apparatus is expensive to manufacture and is very limited in application because the apparatus can only reference an aiming point. This process is time consuming and a shot can not be exactly repeated. All of the above mentioned prior art fail to provide a repeatable condition for shooting exactly the same shot over and over again indicating the exact aiming point, object ball position and cue ball directions for any one of a range of angles for the shot once the training aids are removed from the table surface.

OBJECTS AND ADVANTAGES

Accordingly, several objects and advantages of the present invention are:

(a) To provide a pocket Billiard Aim Instruction Kit showing the accurate aiming location and range of direction for the cue ball direction after impact.

(b) To provide a pocket Billiard Aim Instruction Kit that can be used to set up multiplicity of practice locations on a billiard table surface, while revealing each location's aiming point reference mark, 5 object ball position marks, 5 different aiming angle reference marks and a center hit cue ball direction reference mark once the Billiard Aim Instruction Kit is removed from the billiard table surface.

(c) To provide a Billiard Aim Instruction Kit used to set up a plurality of practice shots in different locations on a pocket billiard table and then once the Position reference tool is removed from the pocket billiard table retain the ability to practice those shots set up with the Billiard Aim Instruction Kit a plurality of times and additionally use said Position Reference tool as a feedback reference for any of the shots executed at any time during the practice session.

Still further objects and advantages will become apparent from a consideration of the ensuing description and drawings.

SUMMARY

In accordance with the present invention a Billiard Aim Instruction Kit comprises a position reference tool, 10 rail indicators, 1 center tip indicator and a position marker used on a billiard table surface to help students indicate the precise locations for a billiard object ball and cue ball at the moment of impact while providing detailed information about cue ball direction after impact between the object ball and cue ball occurs.

DRAWINGS

Drawing Figures

DETAILED DESCRIPTION

Figure 1:
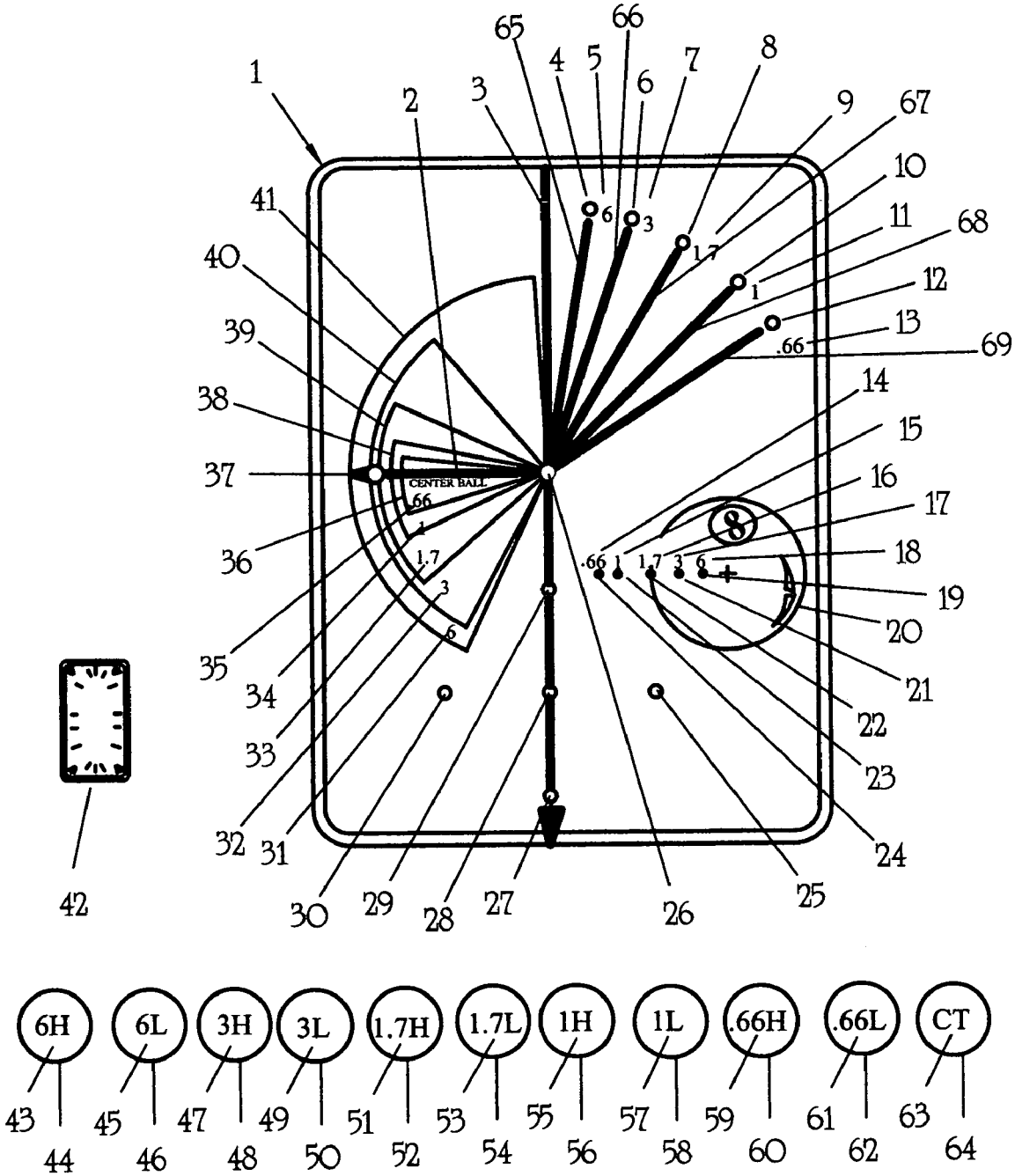
FIG. 1 is a top view of the Billiard Aim Instruction kit showing a position reference tool, 10 rail indicators, 1 center tip indicator and a position marker.
Figure 2:
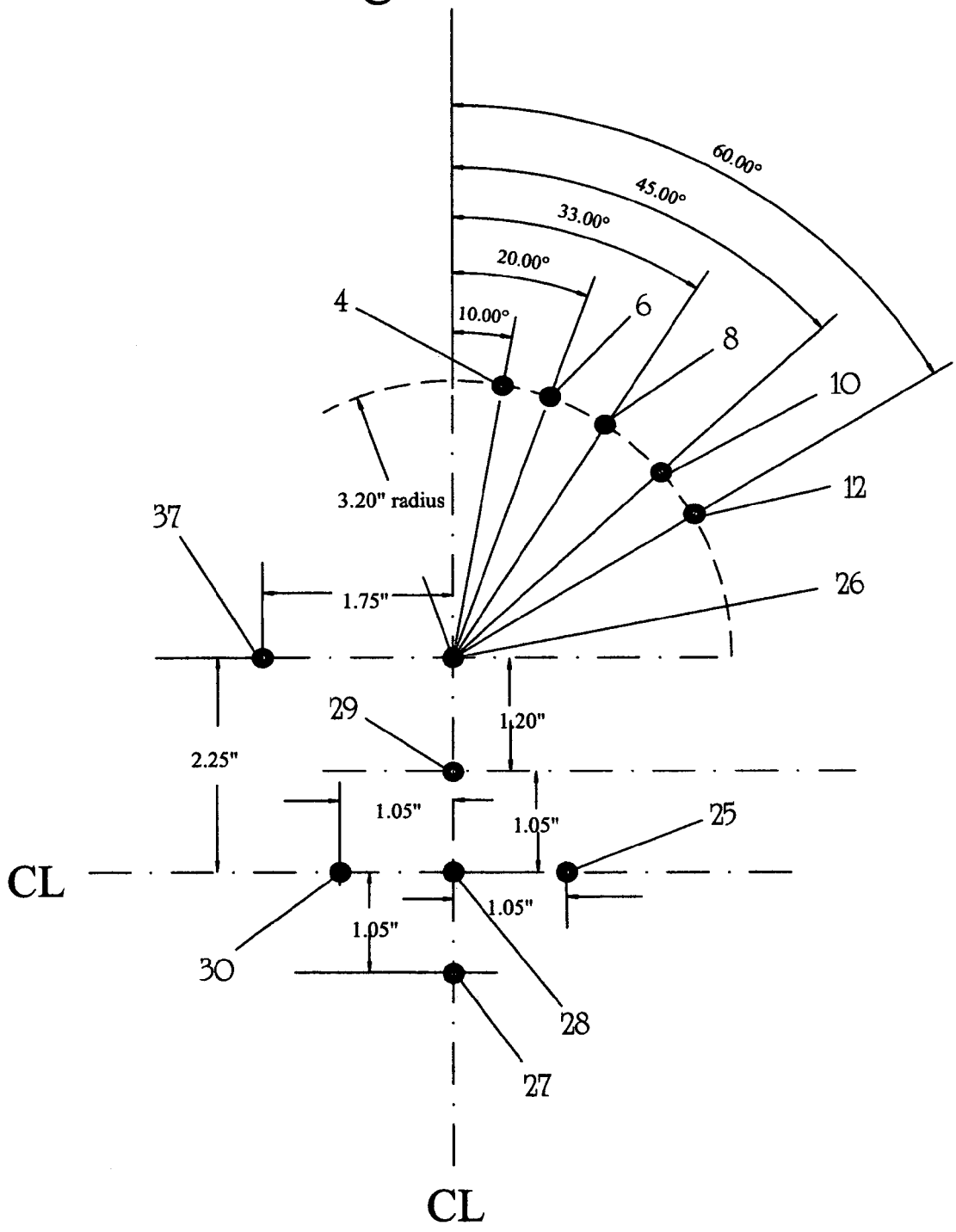
FIG. 2 is a top view showing the precise locations and dimensional relationships of the 12 apertures located on the position reference tool.
Figure 4:
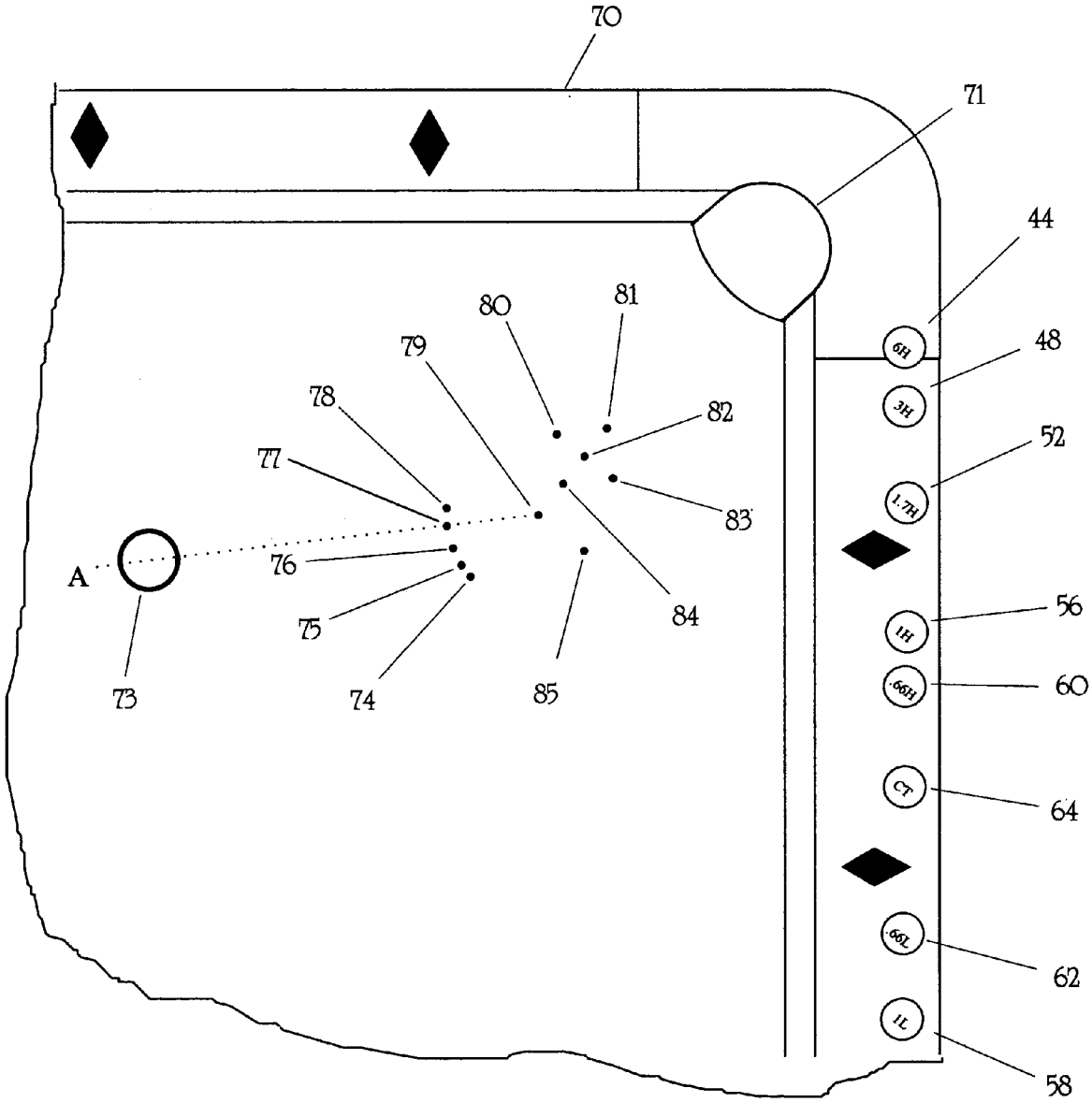
FIG. 4 is a close up view of the pocket billiard table showing the talcum powder marks left at the 12 aperture positions on the position reference tool.
Figure 5:
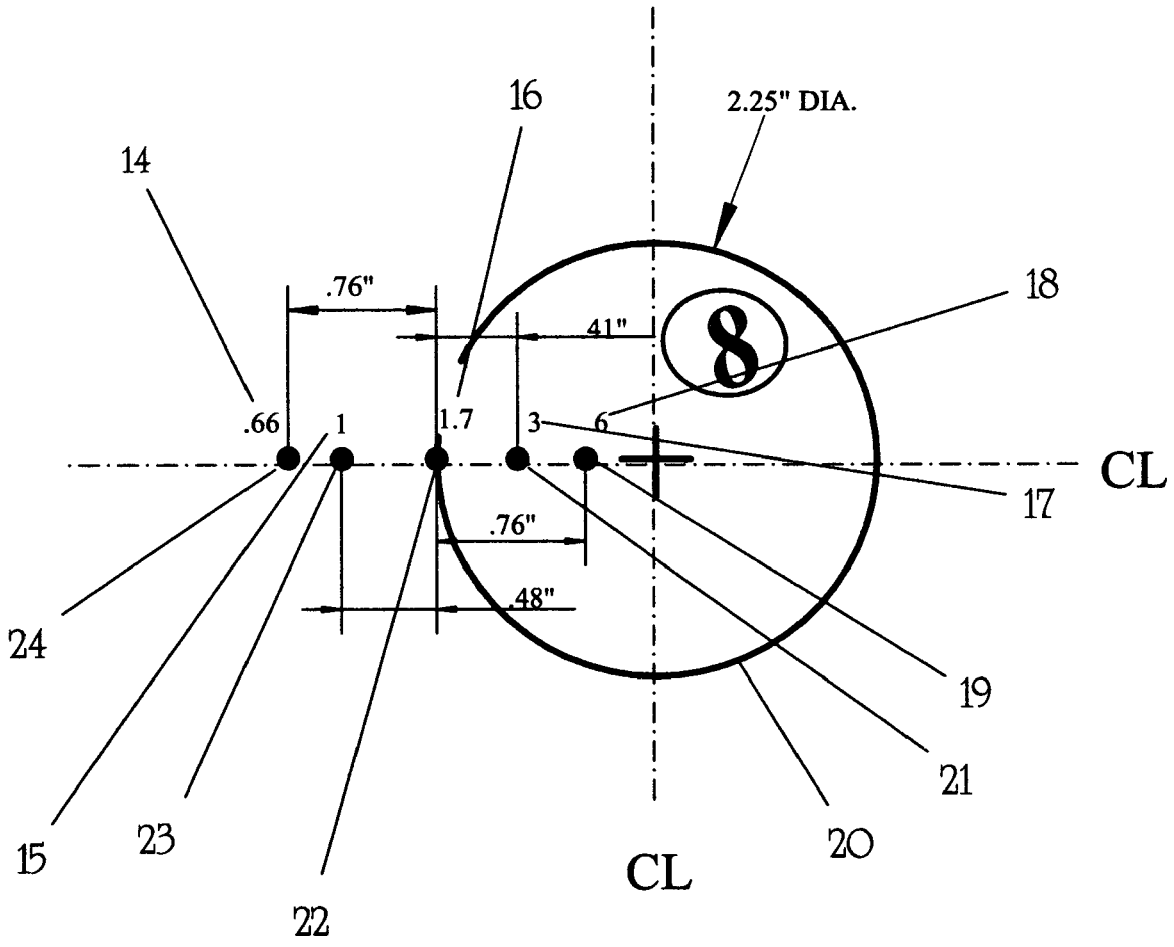
FIG. 5 is a side view of a billiard object ball with dimensional references to object ball aiming points for 5 different angles of aim.
Figure 6:
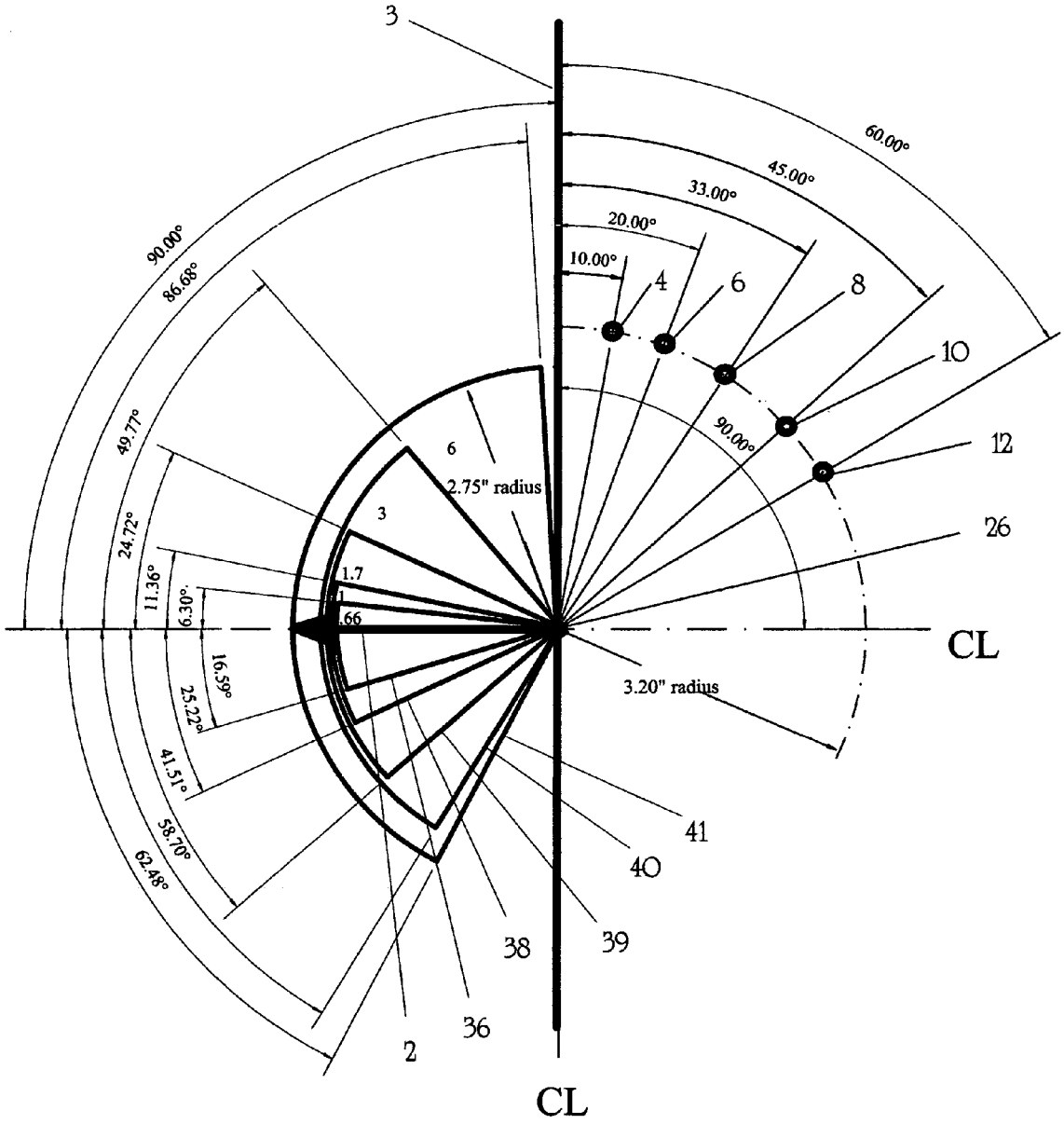
FIG. 6 is a dimensional drawing showing the relationships between angle apertures and range graphics.
Figure 7:
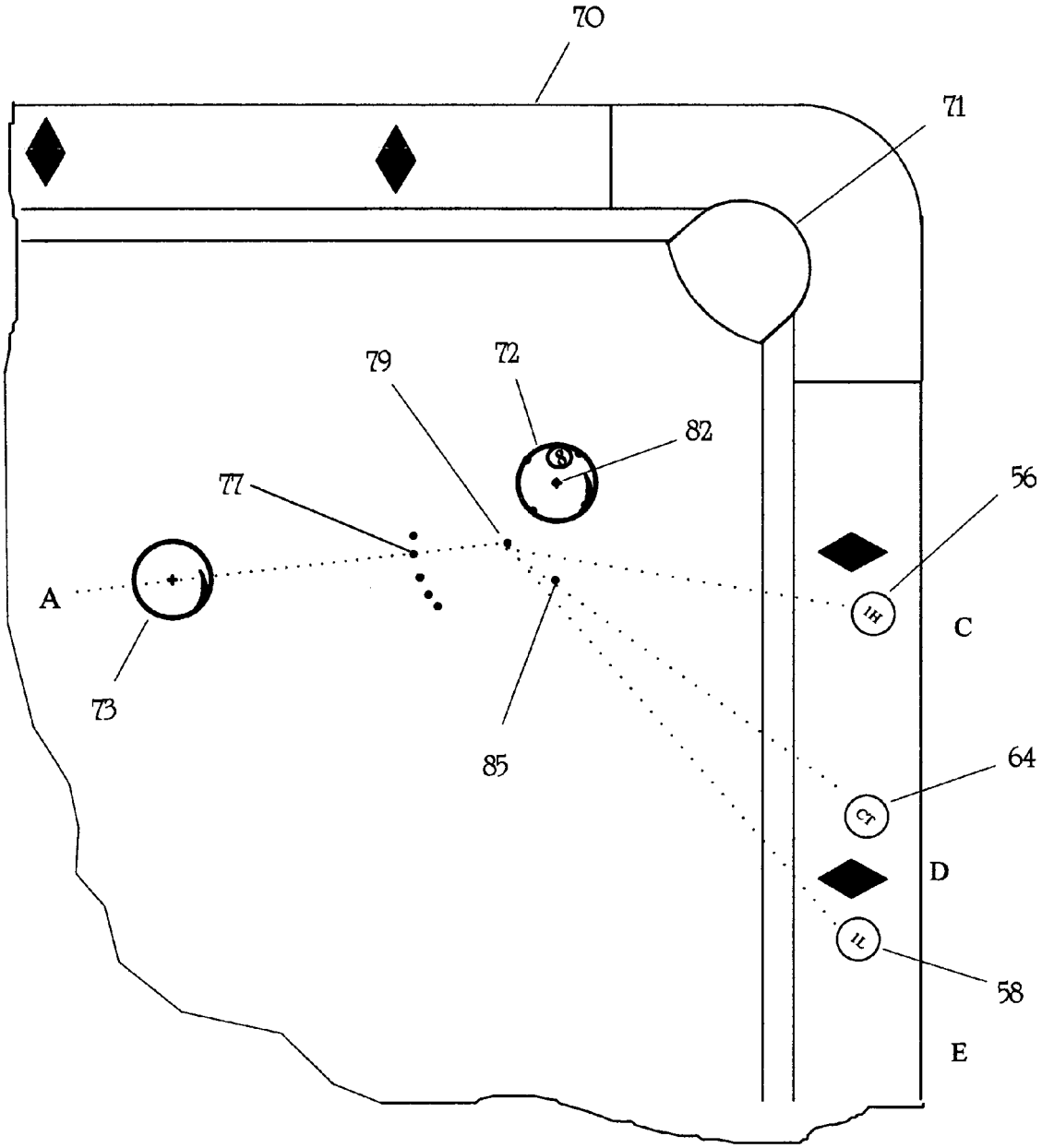
FIG. 7 is a close up view showing how to set up a pocket billiard practice shot.
Figure 8:
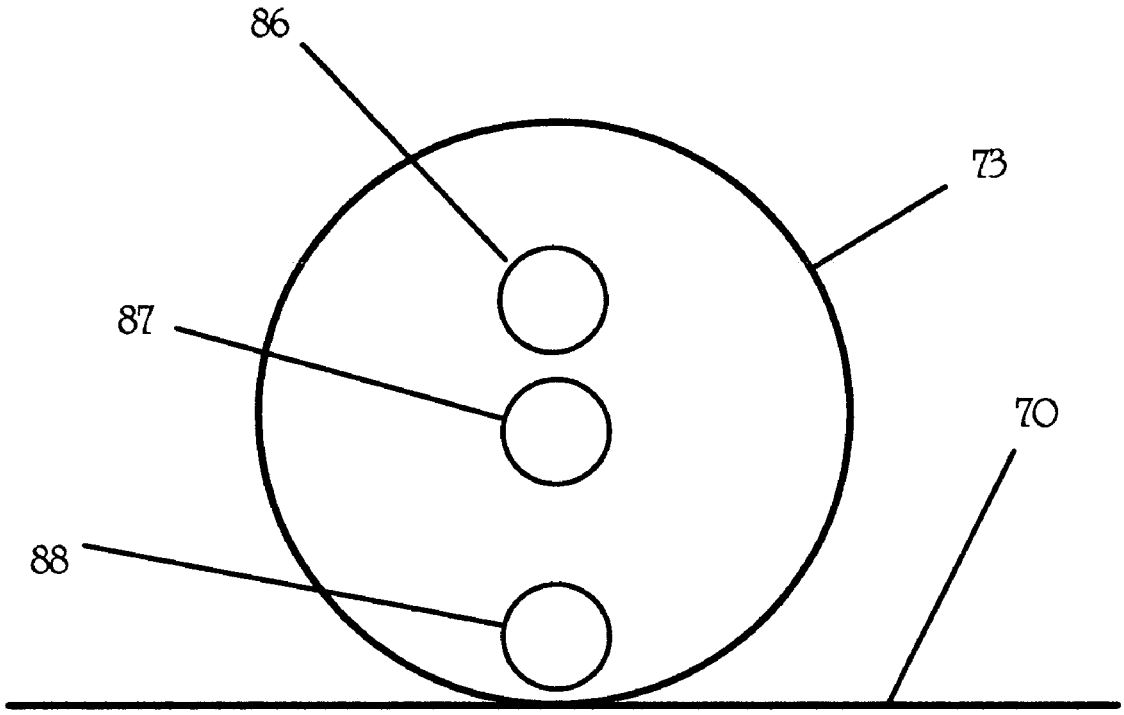
FIG. 8 is a side view illustrating the 3 common locations a cue tip makes contact with a cue ball.
Figure 9:
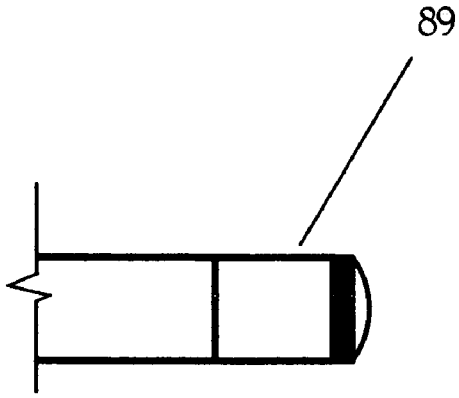
FIG. 9 shows a side view of the tip of a common pocket billiard cue stick.

Referring to FIG. 1, a position reference tool 1 comprises a flat rectangular sheet of plastic with 12 small diameter apertures, angle aperture 6 4, angle aperture 3 6, angle aperture 1.7 8, angle aperture 1 10, angle aperture .66 12, left ball aperture 25, universal point aperture 26, top ball aperture 27, center ball aperture 28, bottom ball aperture 29, right ball aperture 30 and center tip aperture 37 centered upon the surface of the position reference tool 1 and positioned as dimensioned in FIG. 2. The position reference tool 1 is made of flexible thin plastic sheet material. The Line to pocket 3 is a bold black line printed on the surface of the position reference tool 1 and extends from one short side of the rectangle through the centers of the universal point aperture 26, bottom ball aperture 29, center ball aperture 28, and top ball aperture 27 to the opposite short edge of the rectangle. Angle line 6 65 is a bold black line printed on the surface of the position reference tool 1 extending from the center of the universal point aperture 26 to the center of angle aperture 6 4. Angle line 3 66 is a bold black line printed on the surface of the position reference tool 1 line extending from the center of the universal point aperture 26 to the center of angle aperture 3 6. Angle line 1.7 67 is a bold black line printed on the surface of the position reference tool 1 extending from the center of the universal point aperture 26 to the center of angle aperture 1.7 8. Angle line 1 68 is a bold black line printed on the surface of the position reference tool 1 extending from the center of the universal point aperture 26 to the center of angle aperture 1 10. Angle line .66 69 is a bold black line printed on the surface of the position reference tool 1 extending from the center of the universal point aperture 26 to the center of angle aperture .66 12. The angle reference 6 5, angle reference 3 7, angle reference 1.7 9, angle reference 1 11 and angle reference .66 13 are printed on the surface of the position reference tool 1 in close proximity to the angle aperture 6 4, angle aperture 3 6, angle aperture 1.7 8, angle aperture 1 10, angle aperture .66 12 respectively. The object ball graphic 20 is a graphic image of a pocket billiard ball printed on the surface of position reference tool 1. The position marker 42 is a standard small cloth bag of white talcum powder similar to those sold in billiard rooms and bowling alleys as a product useful for keeping hands dry during play. The object ball aim point .66 24, object ball aim point 1 23, object ball aim point 1.7 22, object ball aim point 3 21 and object ball aim point 6 19 are bold black circular dots printed on the surface of the position reference tool 1 having scale dimensional relationships to the object ball 20 as shown in FIG. 5. The aiming reference .66 14, The aiming reference 1 15, The aiming reference 1.7 16, The aiming reference 3 17 and The aiming reference 6 18 are printed on the surface of the position reference tool 1 in close proximity to the object ball aim point .66 24, object ball aim point 1 23, object ball aim point 1.7 22, object ball aim point 3 21, and object ball aim point 6 19 respectively. Referring to FIGS. 1 and 2 angle aperture 6 4, angle aperture 3 6, angle aperture 1.7 8, angle aperture 1 10, angle aperture.66 12 left ball aperture 25, universal point aperture 26, top ball aperture 27, center ball aperture 28, bottom ball aperture 29, right ball aperture 30 and center cue tip aperture 37 are small diameter apertures large enough to allow talcum powder from the position marker 42 to be transferred through the position reference tool 1 on to the surface of a standard billiard table 70 shown in FIG. 3. FIG. 1 shows a range graphic .66 36, range graphic 1 38, range graphic, range 1.7 39, graphic 3 40 and range graphic 6 41 are pictorial graphics printed in the shape of various size circle sectors on the surface of position reference tool 1 and positioned as dimensioned in FIG. 6. Cue ball path reference 6 31, cue ball path reference 3 32, cue ball path reference 1.7 33, cue ball path reference 1 34, and cue ball path reference .66 35, are printed in close proximity to range graphic 6 41, range graphic 3 40, range graphic 1.7 39, range graphic 1 38 and range graphic .66 36 respectively. In FIG. 1 rail indicator 6H 44, rail indicator 6L 46, rail indicator 3H 48, rail indicator 3L 50, rail indicator 1.7H 52, rail indicator 1.7L 54, rail indicator 1H 56, rail indicator 1L 58, rail indicator .66H 60, rail indicator .66L 62 and rail indicator CT 64 are small plastic discs small enough to sit upon the rails of a standard pocket billiard table 70 of FIG. 3. The direction reference 6H 43, direction reference 6L 45, direction reference 3H 47, direction reference 3L 49, direction reference 1.7H 51, direction reference 1.7L 53, direction reference 1H 55, direction reference 1L 57, direction reference .66H 59, direction reference .66L 61, and direction reference CT 63 are text graphics printed on the surface of rail indicator 6H 44, rail indicator 6L 46, rail indicator 3H 48, rail indicator 3L 50, rail indicator 1.7H 52, rail indicator 1.7L 54, rail indicator 1H 56, rail indicator 1L 58, rail indicator .66H 60, rail indicator .66L 62 and rail indicator CT 64 respectively. In FIG. 3, FIG. 4, FIG. 7 and FIG. 8 the cue ball. 73 is a standard cue ball used in the game of pocket billiards. In FIG. 7 the object ball 72 is a standard pocket billiard ball marked with a number from 1 to 15 used in the game of pocket billiards. In FIG. 9 the tip of the cue 89 is a standard cue tip found on the end of all standard billiard cue sticks used in the game of pocket billiards. In FIG. 1 the center ball line 2 is a bold black line with an arrowhead graphic extending from the center of universal point aperture 26 at an angle perpendicular to the line to pocket 3. As stated earlier, other embodiments are possible such as using color coding instead of reference numbers to describe the relationships between angles and cue ball direction. Another embodiment can use pocket billiard chalk instead of talcum powder to mark the position of the position reference tool 1.

Operation

Figure 3:
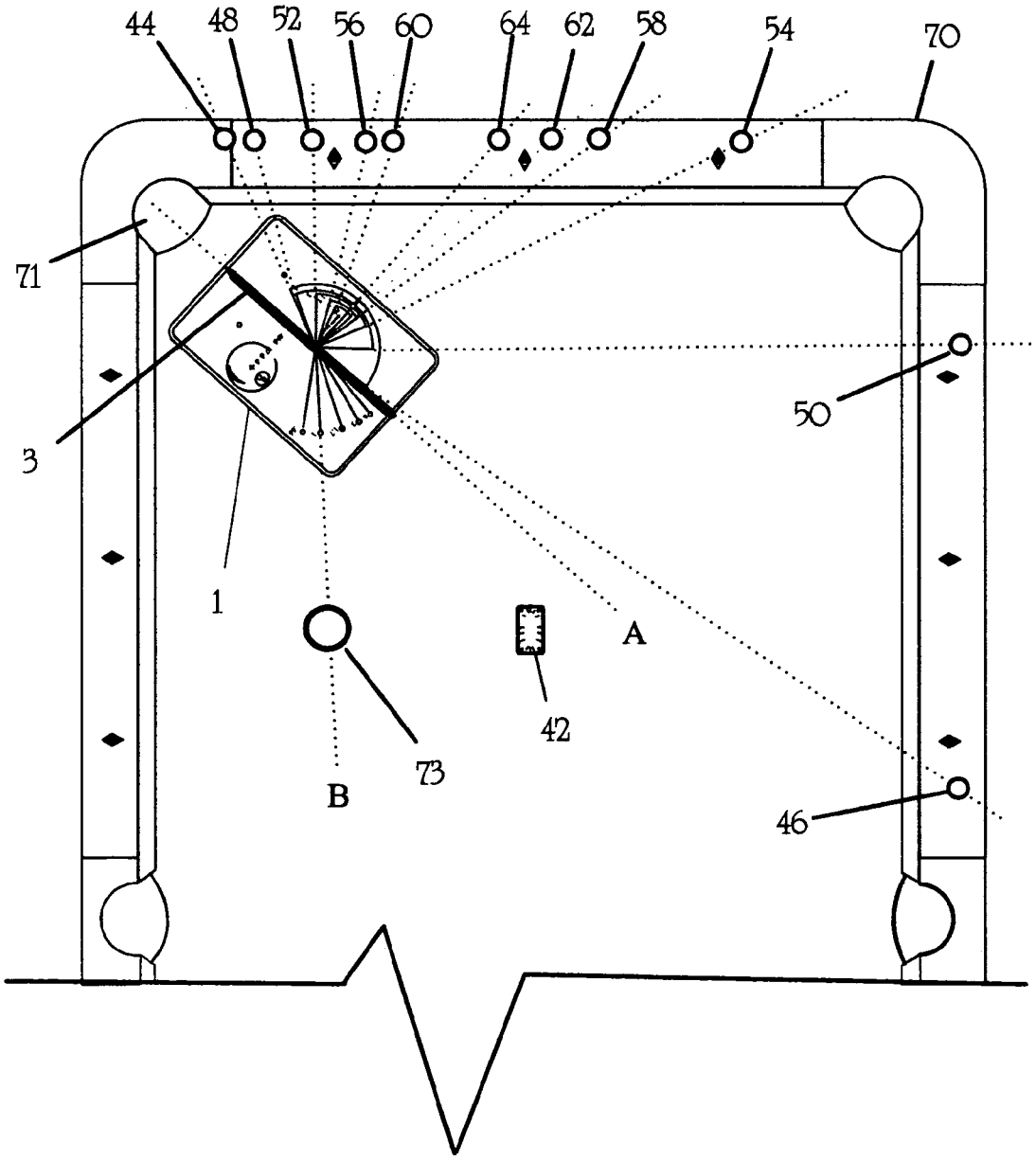
FIG. 3 is a top view showing a standard pocket billiard table with the position reference tool positioned on the table surface and the 11 rail indicators positioned on the rails of the pocket billiard table.

FIG. 3 shows how the position reference tool 1 is set up to practice pocket billiard shots on a standard pocket billiard table 70. The position reference tool 1 is positioned on the surface of pocket billiard table 70 by aligning the line to pocket 3 touching and parallel with an imaginary line extending through the center of the billiard pocket 71 as shown in FIG. 3. Once the position reference tool 1 is properly aligned, the student uses the position marker 42 to apply a light coat of talcum powder on to the billiard table 70 surface using the position reference tool 1 as a mask or stencil, moving the position marker 42 back and forth with a daubing patting and wiping motion over the angle aperture 6 4, angle aperture 3 6, angle aperture 1.7 8, angle aperture 1 10, angle aperture .66 12, left ball aperture 25, universal point aperture 26, top ball aperture 27, center ball aperture 28, bottom ball aperture 29, right ball aperture 30 and center tip aperture 37. The student then finds the 2 straight sides for each circle sector shaped range graphic .66 36, range graphic 1 38, range graphic, range 1.7 39, graphic 3 40 and range graphic 6 41. The student places rail indicator. 6H 44, rail indicator 6L 46, rail indicator 3H 48, rail indicator 3L 50, rail indicator 1.7H 52, rail indicator 1.7L 54, rail indicator 1H 56, rail indicator 1L 58, rail indicator .66H 60 and rail indicator .66L 62 on the rails of the pocket billiard table 70 making sure to position each indicator is aligned and centered along imaginary lines extending from the center of the universal point aperture 26 touching and parallel to both straight sides of each range graphic .66 36, range graphic 1 38, range graphic, range 1.7 39, graphic 3 40 and range graphic 6 41 as shown by the dotted lines in FIG. 3. The student places the center tip indicator 64 on the rail of the pocket billiard table 70 making sure to position the center tip indicator 64 aligned and centered on an imaginary line from the center of the universal point aperture 26 touching and parallel to the center ball line 2 as shown by the dotted line in FIG. 3. After the student has marked the pocket billiard table 70 using the position reference tool 1 with the position marker 42 and placed the center tip indicator 64 and rail indicators 44, 48, 52, 56, 60, 62, 58, 54, 50 and 46 on the rails of the pocket billiard table 70 at their defined locations, the position reference tool 1 is removed to reveal a residue of talcum powder forming the pattern on the pocket billiard table 70 as shown in FIG. 4. The pattern in FIG. 4 consists of angle mark 6 74, angle mark 3 75, angle mark 1.7 76, angle mark 1 77, angle mark .66 78, universal point mark 79, left ball mark 80, top ball mark 81, center ball mark 82, right ball mark 83, bottom ball mark 84 and center tip mark 85. Before going further the relationships between the angle marks, direction references, angle references, rail indicators, aiming references and object ball aiming points must be understood. Each angle mark has 2 relative direction references. As an example, direction reference 1H 56 and direction reference 1L 58 are relative to angle mark 1 77 as shown in FIG. 7. Angle reference 6 5, angle reference 3 7, angle reference 1.7 9, angle reference 1 11, angle reference .66 13 is relative to the direction reference CT 63. Angle mark 6 74, angle mark 3 75, angle mark 1.7 76, angle mark 1 77 and angle mark .66 78 is relative to the rail indicator CT 64. Aiming reference .66, 14, aiming reference 1, 15, aiming reference 1.7, 16, aiming reference 3, 17 and aiming reference 6 18 is relative to angle reference .66 13, angle reference 1 11, angle reference 1.7 9, angle reference 3 7 and angle reference 6 5 respectively. Angle mark 6 74, angle mark 3 75, angle mark 1.7 76, angle mark 1 77, and angle mark .66 78, is relative to object ball aim point 6 19, object ball aim point 3 21, object ball aim point 1.7 22, object ball aim point 1 23 and object ball aim point .66 24 respectively. In FIG. 4 the cue ball 73 is placed centered anywhere along the length of imaginary line "A" starting from the center of the universal point mark 79 extending through the center of angle mark 1 77. In FIG. 7 the object ball 72 is placed centered on the center ball mark 82. The left ball mark 80, top ball mark 81, right ball mark 83 and bottom ball mark 84 are used to double check the alignment of the circumference of the object ball 72 and further insure the exact centered position. The student now observes the rail indicator 1H 56, rail indicator CT 64 and rail indicator 1L 58 relative to the angle mark 77 also shown in FIG. 7. The student is now ready to aim the shot to pocket the object ball 72 in the billiard pocket 71 and study different cue ball 73 positions after applying high cue impact point 86, center impact point 87 or low impact point 88 to the cue ball 73 with the tip of the cue 89. To shoot the angle mark 1 77 shot with high cue impact point 86 the student aims the tip of the cue 89 at the universal point mark 79, taking mental note of the object ball aim point 1 23 on the position reference tool 1, while applying the high cue impact point 86 strokes through the cue ball attempting to pocket the object ball 72 in the billiard pocket 71 and position the cue ball near the rail indicator 1H 56. If the student wishes to practice the same angle mark 1 77 using low cue impact point 88 the objective will be to pocket the object ball 72 in the billiard pocket 71 and position the ball near rail indicator 1L 58. If the student wishes to practice the same angle mark 1 77 using center cue impact point 87 the objective will be to pocket the object ball 72 in the billiard pocket 71 and position the ball near rail indicator CT 64. The same procedure is used for the other 4 angle marks. The Billiard Aim Instruction Kit is susceptible to various embodiments and forms. For instance, color coding could be used to illustrate the relationships between angles, aiming points and cue ball directions. Paper or metal can be used instead of plastic for the material of construction of the position reference tool. Colored beads can be used instead of lettered and numbered plastic discs for the rail indicators. Angle apertures 4,6,8,10,12, and center tip aperture 37 can be repeated at mirror image positions on the opposite side of the line to pocket 3 Relative range graphics 36, 38, 39, 40 and 41 can be printed as mirror images on the opposite side of the line to pocket 3. Accordingly, there is described in the drawings and specification a preferred embodiment to be considered as one exemplification of the invention and is not intended to limit the broad scope of the invention to the embodiment.

CONCLUSIONS AND RAMIFICATIONS

Accordingly, While my above description contains many specificities these should not be construed as limitations on the scope of the invention, but rather as an exemplification of one preferred embodiment thereof. Many other variations are possible. Some examples are changes to the shape of the Position Reference Tool, using metal instead of plastic for the Position reference tool, using color coding for the rail indicators and angle range graphics, using beads or other shapes for the rail indicators using angle references other than those shown on the graphics as long as they are precisely measured and empirically tested to modify the range graphics and applying the billiard games other than pocket billiards as long as the size of the billiard balls are tested and associated to the graphics by empirical testing. Accordingly, the scope of the invention should be determined not by the embodiment but by the appended claims and their legal equivalent.

The invention claimed is:

1. A billiard aim instruction kit for placing temporary precision marks upon a billiard table surface to practice producing a preferred path of a first billiard ball while at the same time producing a preferred path of a second billiard ball after said first billiard ball and said second billiard ball collide with each other, said billiard aim instruction kit comprising:

a) a position reference tool said position, reference tool including a sheet material said sheet material having three or more sides with a top surface and a bottom surface said top surface having a multiplicity of primed graphic images, and a multiplicity of small-diameter apertures are positioned at precisely measured locations correlating to said multiplicity of printed graphic images, said multiplicity of small-diameter apertures extending completely through said top and bottom surfaces of said position reference tool;

b) a position marker said position marker including a small dispenser suitable for depositing finely milled powder through said small-diameter apertures of said position reference tool for placing temporary precision marks upon a billiard table surface; and c) a multiplicity of rail indicators, each rail indicator of said multiplicity of rail indicators is a small coded marker indicating the desired direction of a cue ball after collision with an object ball during practice on a billiard table;

wherein said billiard aim instruction kit when used in conjunction with a standard billiard table and billiard balls, offers a person an optimum utility for learning the principles of controlling object ball and cue ball direction after collision with each other.

2. The billiard aim instruction kit of claim 1 wherein said position reference tool is a rectangular four sided sheet of plastic having a top surface and a bottom surface a multiplicity of graphic images printed on said top surface and a multiplicity of small-diameter apertures positioned at precisely measured locations correlating to said multiplicity of graphic images said multiplicity of small-diameter apertures extending completely through said top and bottom surfaces of said position reference tool.

3. The billiard aim instruction kit of claim 1 wherein said position reference tool is a rectangular four sided sheet of plastic baying a top surface and a bottom surface and said multiplicity of graphic images printed on said top surface depicts a line to pocket, five angle lines with correlating angle numbers, a center ball line, five object ball aiming point dots with correlating angle numbers, five range graphics with correlating angle numbers and an object ball with a multiplicity of small-diameter apertures positioned at precisely measured locations correlating to said multiplicity of graphic images and said multiplicity of small-diameter apertures extending completely through said top and bottom surfaces of said position reference tool.

4. The billiard aim instruction kit of claim 1 wherein said position reference tool is a rectangular four sided sheet of plastic having a top surface and a bottom surface and said multiplicity of graphic images printed on said top surface depicts a line to pocket, five angle lines with correlating angle numbers, a center ball line, five object ball aiming point dots with correlating angle numbers, five range graphics with correlating angle numbers and an object ball and wherein said multiplicity of small-diameter apertures positioned at precisely measured locations correlating to said multiplicity of graphic images comprises five angle apertures, a left ball aperture, one universal point aperture, top ball aperture, a center ball aperture, a bottom ball aperture a right ball aperture and a center cue tip aperture and said multiplicity of small-diameter apertures extending completely through said top and bottom surfaces of said position reference tool.

5. The billiard aim instruction kit of claim 1 wherein said multiplicity of rail indicators including a multiplicity of small plastic discs having a top surface and a bottom surface, a direction reference printed on said top surface of each one of said multiplicity of small-plastic discs, said direction reference graphic depicts a direct relationship to said multiplicity of printed graphic images on said position reference tool.

6. The position marker of claim 1 wherein said small dispenser is a small cloth bag containing a finely milled powder enclosed within said cloth bag having a weave capable of metering or sifting said finely milled powder through said cloth bag to promote deposition of said finely milled powder on to said top surface of said position reference tool.

* * * * *